United States Patent [19]

Burger et al.

[11] Patent Number: 5,072,719

[45] Date of Patent: Dec. 17, 1991

[54] AIR SUPPLY SYSTEM FOR A FIREBOX

[76] Inventors: Hans Burger, Wydenstrasse 17, CH-3076 Worb; Dieter Grimm, Mühlegasse 7, CH-3612 Steffisburg, both of Switzerland

[21] Appl. No.: 601,352

[22] Filed: Oct. 23, 1990

[30] Foreign Application Priority Data

Oct. 30, 1989 [CH] Switzerland ..... 3915/89

[51] Int. Cl.[5] ..... F24C 00/00

[52] U.S. Cl. ..... 126/515; 126/500; 454/284; 454/292; 454/903

[58] Field of Search ..... 126/515, 517, 516, 518, 126/500; 98/40.01, 48, 103, DIG. 7

[56] References Cited

U.S. PATENT DOCUMENTS 976,819 11/1910 Matter ..... 126/515

1,415,345 5/1922 Hatchett ..... 126/515 X 2,725,874 12/1955 Payne ..... 126/515

*Primary Examiner*—Larry Jones

*Attorney, Agent, or Firm*—Brady, O'Boyle & Gates

[57] ABSTRACT

The air supply system for feeding air to a firebox within a building comprises a fresh air intake box (3) in the outside building wall (19) and, in the immediate vicinity of the firebox, a distributor box (7), connected with several pipes (5*a*, 5*b*, 5*c*, 5*d*). The fresh air intake box (3) has an extensible tube (25) for adaptation to varying wall thicknesses of the outside building wall (19). The prefabricated parts can be readily installed on the building site. By the use of several pipes (5*a*, 5*b*, 5*c*, 5*d*), the individual pipe cross section can be kept at a small value so that no static impairment of the building ceiling (11), wherein the pipes (5*a*, 5*b*, 5*c*, 5*d*) are extended, occurs. Advantageously, a fan can be installed in the extensible and readily removable tube (25) in order to increase the flow velocity of the fresh air; servicing of the fan is possible without any problems.

11 Claims, 2 Drawing Sheets

AIR SUPPLY SYSTEM FOR A FIREBOX

The invention relates to an air supply system to a process for the production of an air supply system to a fresh air intake box for performing the process and to a distributor box for performing the process.

BACKGROUND OF THE INVENTION

A partially open firebox of a fireplace (hearth) as well as a firebox (furnace) closed except for the air supply are utilized in residences and are to contribute toward a cozy room atmosphere, particularly on cold and humid days. Approximately 300-500 $m^3$ of room air per hour are required for the flawless operation of an open fireplace in a residence. The air is supplied, inter alia, through cracks in windows and doors. Since here the air supply is frequently inadequate, smoke can enter the living space.

In a conventional improved arrangement, the required air is supplied through a partially open basement window and a floor aperture in the immediate vicinity of the firebox. As a result, the basement becomes colder; the window must be screened in order to prevent animals (mice, rats, martens, cats) from entering the basement.

In another known system, the flue of the fireplace is located in the direct proximity to an outer building wall wherein an opening is provided. Air is taken in through this opening on account of the hot flue gases exiting the room via the chimney. The taken in air is frequently conducted, for warming up purposes, through a heat exchanger heated by the hot flue gases or by the radiant heat from the burning material. This conventional air supply unit operates satisfactorily with respect to the amount of air supplied and the heating of the latter; however, the installation site for the open firebox is linked to the proximity of an outer wall of the building.

SUMMARY OF THE INVENTION

The invention is based on the object of providing an air supply system of the type discussed hereinabove which can be installed in a simple way and makes it possible to arrange the firebox on any desired floor of a building at a distance from the outer building walls and to ensure adequate air supply for the combustion process in the firebox.

The solution of this problem with regard to the air supply system is set forth in claim 1; with regard to the process for establishing the air supply system, in claim 4; with regard to the fresh air intake box for performing the process, in claim 7; and with regard to the distributor box for performing the process, in claim 10.

Claims 2 and 3 set forth preferred embodiments of the air supply system according to this invention; claims 5 and 6 contain preferred embodiments of the process, and claims 8 and 9 disclose preferred embodiments of the fresh air box.

One example of the air supply system of this invention, of the process for establishing the air supply system, of the fresh air intake box, and of the distributor box will be described in greater detail below with reference to the drawings, wherein:

DESCRIPTION OF THE PREFERRED EMBODIMENTS

Figure 1:
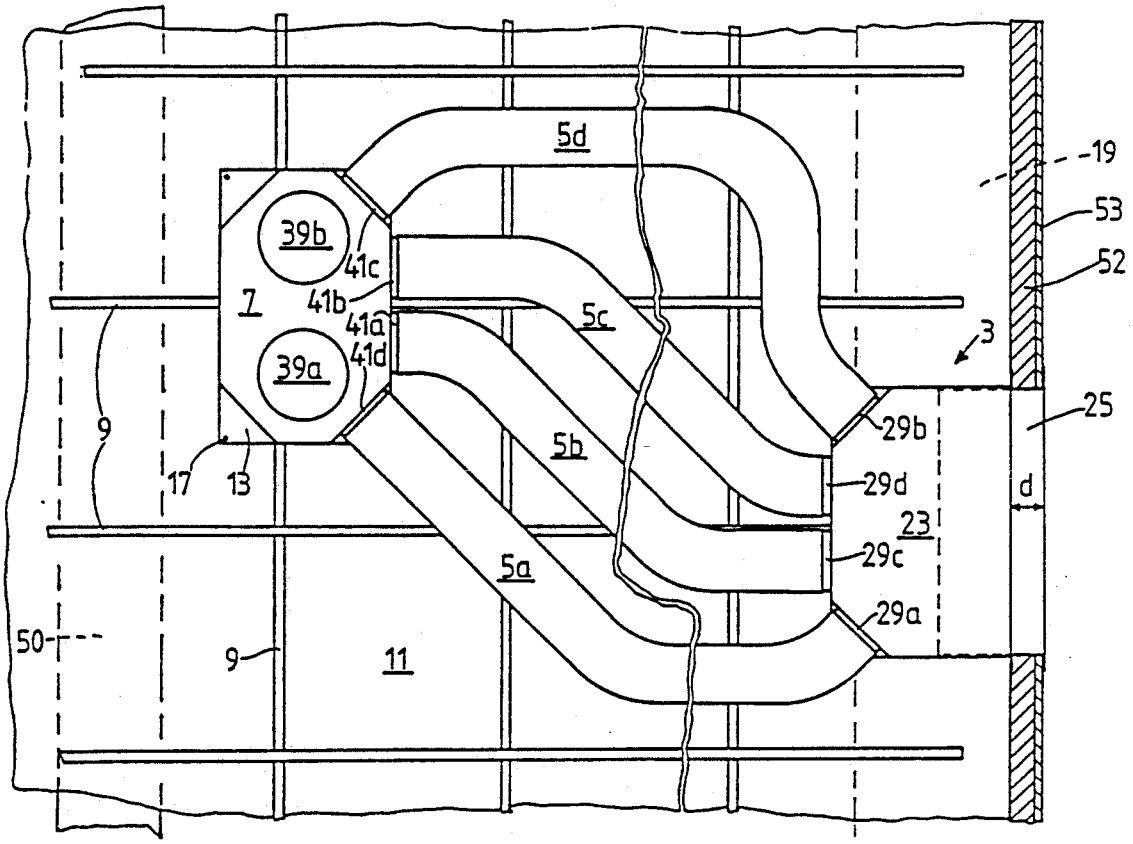
FIG. 1 shows a schematic view of an air supply system in a ceiling and outer wall of a building to be erected.
Figure 2:
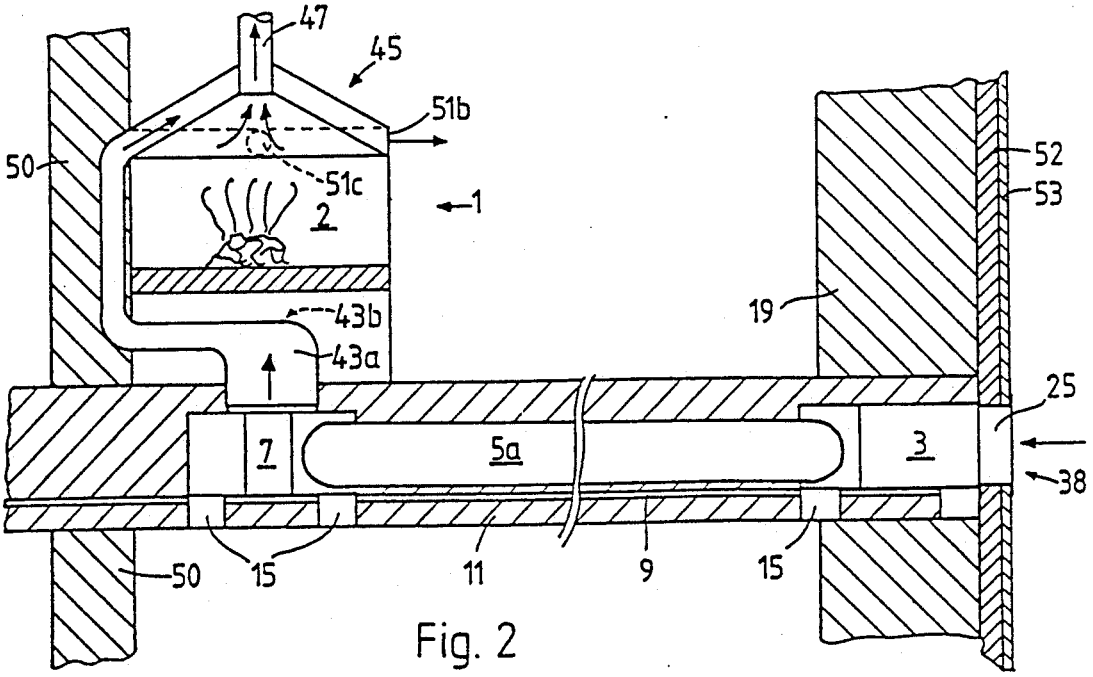
FIG. 2 shows a section through the air supply system for the fireplace.
Figure 6:
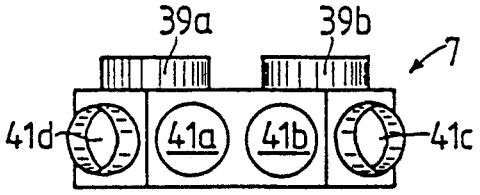
FIG. 6 is a view of the pipe connection member of the distributor box in viewing direction VI of FIG. 5.
Figure 5:
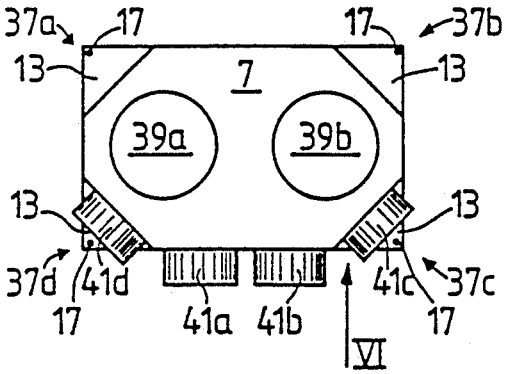
FIG. 5 is a top view of the distributor box of the air supply system.
Figure 3:
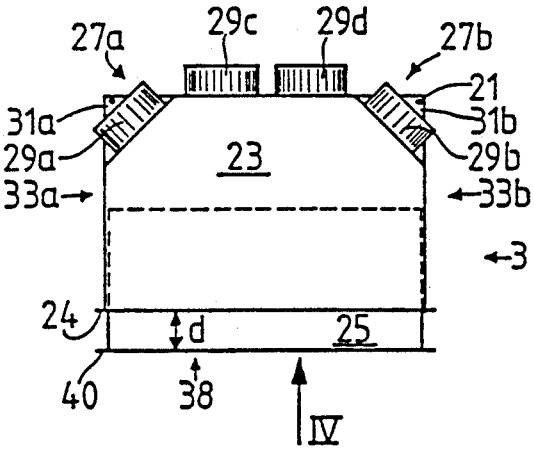
FIG. 3 shows a top view of the fresh air intake box of the air supply system.

The air supply system illustrated in FIG. 1 for feeding air to a partially open fireplace 1 with a firebox 2, shown schematically in FIG. 2, comprises a fresh air intake box 3 connected by means of four flexible pipes 5*a* through 5*d* to a distributor box 7. The distributor box 7 and the flexible pipes 5*a* to 5*d* are located within a covering (not shown) above the reinforcing bars 9 of a ceiling 11 for a building, to be installed. The distributor box 7 is mounted to the covering against displacement on four fishplates 13 via respectively one spacer means 15 with nails 17.

The fresh air intake box 3 lies approximately in the same horizontal position with respect to the distributor box 7 in the outer wall 19 of the building and is likewise attached via four spacer means 15 with nails 21. The box 3 consists of a basic box 23 wherein a tube 25 is displaceably inserted. The basic box 23 is a square receptacle open on one side and provided with a rim 24; both corners 27*a* and 27*b* of this box which face away from the open side are beveled at approximately 45° and each carries a pipe connection member 29*a* and 29*b*. Another two pipe connection members 29*c* and 29*d* are located on the side facing away from the open side. The base panel of the basic box 23 is approximately a square and forms, below the beveled corners 27*a* and 27*b*, two perforated fishplates 31*a* and 31*b* which serve for the aforementioned mounting of the basic box 23 during installation of the ceiling 11 of the building and the outer wall 19 of the building. The sides 33*a* and 33*b* extend from the open side slightly conically toward the rearward side so that, as set forth below, an inserted prop means can be readily pulled out again.

The tube 25 is fashioned as a quadrangular pipe in such a way that it can be displaced within the basic box 23. The tube 25 projects past the basic member 23 by a distance d. The distance d corresponds to the sum total of a minimum thickness of a building insulation 52 to be applied to the outside house wall 19 and of a finish 53 to be applied thereover. If a thicker building insulation 52 or a thicker finishing cover 53 is applied, then the tube 25 can be correspondingly pulled out of the basic box 23. The opening 38, facing away from the base box 23, serves as the air inlet port and is surrounded by a rim 40. The tube 25 can be pushed into the basic box 23 until the tube rim 40 abuts against the box rim 24.

The distributor box 7 is a square box with corners 37*a*-37*d*, beveled at approximately 45° and with two air outlet ports 39*a* and 39*b* on its topside. The base plate of the distributor box 7 is approximately square and forms, underneath the beveled corners 37*a* to 37*d*, the four fishplates 13 provided with holes, serving for the above-mentioned mounting of the distributor box 7 during the installation of the ceiling 11 for the building. Two pipe connection members 41*a* and 41*b* are located on one of the broad sides, and respectively one further pipe connection member 41c and 41d is arranged on the neighboring, beveled corners 37c and 37d.

The air outlet ports 39a and 39b are in communication, via two pipes 43a and 43b, with a heat exchanger 45 illustrated in FIG. 2. The heat exchanger 45 is arranged around a flue 47 through which the flue gases of a firebox 2, open toward three sides, are withdrawn, and is located above the firebox 2. The fourth side of the firebox 2 constitutes an inner building wall 50 lined with refractory tiles (not shown). The flue 47 is extended upwardly along this last-mentioned wall to the roof (not illustrated). The heat exchanger 45 exhibits respectively one exhaust opening 51a through 51c (51a not being illustrated) toward each of the three sides open toward the room, through which the air heated in heat exchanger 45 can flow out.

The mounting of the air supply system for the fireplace 1 takes place during the erection of the building during the installation of the ceiling 11 for the building. For this purpose, a shell (not shown) is built up which carries the concrete of the building ceiling 11 up to its own load-carrying ability. A grid of reinforcing bars 9 is installed in the form and subsequently the distributor box 7 with top-positioned air outlet parts 39a and 39b is secured against displacement at the location of the fireplace 1 to be built, as mentioned above, at its four fishplates 13 on spacer means 15 to the form by means of nails 17. The duct 25 of the fresh air intake box 3 is completely inserted in the basic box 23, and the inner cavity of the fresh air intake box 3 is filled with blown foam material (not shown) or a block (slab) of foam material (not illustrated) is inserted as the supporting means. The foam material is to prevent compression of the fresh air intake box 3 during the subsequent erection of the outer wall 19 for the building. The air inlet port 38 of the fresh air intake box 3 and the air outlet ports 39a and 39b of the distributor box 7 are sealed (for example with synthetic resin covers) so that no concrete or dirt can penetrate during the production of the ceiling 11 and the outside wall 19 for the building. Respectively one pipe 5a through 5d is pushed with a clamping seat onto the pipe connection members 41a through 41d of the distributor box 7, installed in the form, cut to the correct length, and pushed with clamping fit onto the pipe connection members 29a through 29d of the fresh air intake box 3. The building ceiling 11 can then be covered with concrete and subsequently the outside wall 19 of the building can be erected.

Once the building ceiling 11 has set, the fireplace 1 can be built with the interior finishing of the respective room, and the heat exchanger 45 can be connected, as described above, with the air outlet ports 39a and 39b of the distributor box 7.

After erection of the outer wall 19 for the building, the foam material is removed from the fresh air intake box 3 through the air inlet port 38. This pulling out step is feasible without any problems since, as explained above, the width of the fresh air intake box 3 flares slightly toward the air inlet port 38. Subsequently, a building insulation 52 and a finish 53 are applied to the outside of the outer house wall 19. The duct 25 is pulled out of the basic box 23 of the fresh air intake box 3 to such an extent that its rim 40 rests on the outside of the finish 53. The rim 40 has two holes 54 serving for the attachment of the tube 25 with screws or nails in the finish 53 and/or in the building insulation 52.

On account of the hot flue gases rising during operation of the fireplace 1 and moving past the heat exchanger 45 and being exhausted through the flue 47, cold outside air is taken in through the air inlet port 38. The cold outside air flows through the fresh air intake box 3, the pipes 5a–5d, the distributor box 7, the pipes 43a and 43b, the heat exchanger 45, and passes, heated by the latter, into the living space wherein the fireplace 1 is located.

Figure 4:
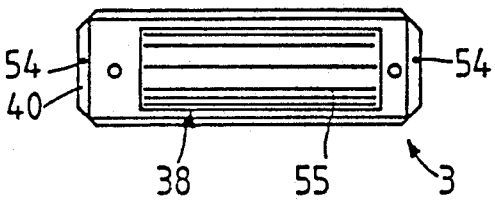
FIG. 4 shows an elevational view of the air inlet port of the fresh air intake box in viewing direction IV of FIG. 3.

With strong heating of the heat exchanger 45 by the flue gases, the air flowing therethrough is likewise strongly heated and thereby can exhibit a fusty "burnt smell" which is undesirable in the residence. This "burnt smell" can be avoided by passing the air quickly through the heat exchanger 45, thus heating the air to a lesser extent. In order to drive the airstream faster through the heat exchanger 45, a cross-current fan 55 is inserted in the tube 25 of the fresh air intake box 3, as illustrated in FIG. 4.

Since the tube 25 is attached merely by two screws and otherwise is freely movable within the basic box 23, the tube can be disassembled without problems and rapidly for purposes of servicing or for replacement of the crosscurrent fan 55.

Instead of conducting the entire fresh air via the pipes 43a and 43b for heating into the heat exchanger 45, only the pipe 43a can be extended to the heat exchanger 45, and the other pipe can be extended to a grating (not shown) underneath the firing material in order to supply the latter directly with fresh air.

In place of using a partially open firebox 2, it is also possible to employ a closed firebox. Also, the distributor box 7 can be supported during concrete application analogously to the fresh air box 3 with a foam block (not shown) which is later on removed again through one of the air outlet ports 39a or 39b.

Since the air supply system consists of a prefabricated distributor box 7 and a prefabricated fresh air intake box 3 with only flexible interconnecting pipes 5a to 5d that can be cut to the desired size easily at the building site with sheet-metal shears or a saw, an extremely simple and quick, modular assembly is ensured. Due to the extensible tube 25, the fresh air intake box 3 can always be installed flush with the outside of the building; during subsequent building renovations, additional insulations or weather-protective panels can be attached without any problems. Since several pipes, preferably four pipes 5a through 5d, are utilized as the connection between the fresh air intake box 3 and the distributor box 7, a large quantity of air can be transported with low flow resistance without any appreciable static weakening of the ceiling 11 of the building. On account of the flow cross section which is large in total, the air velocity is low whereby no disturbing noises occur.

What is claimed is:

1. An air supply system in the ceiling of a building for feeding air to a firebox (2) within a building, comprising a fresh air intake box (3) in the outside wall (19) of the building, said box being provided with a plurality of pipe connection members (29a, 29b, 29c, 29d) and at least one air inlet port (38), a distributor box (7), said distributor box provided with a plurality of second pipe connection members (41a, 41b, 41c, 41d) and at least one air outlet port (39a, 39b), said distributor box being located in the proximity of the firebox (2), and a plurality of pipes (5a, 5b, 5c, 5d) in the ceiling of the building connecting said plurality of pipe connection members of said fresh air intake box (3) with said plurality of second pipe connection members of said distributor box (7).

2. An air supply system according to claim 1, including a heat exchanger (45) connected in the direct vicinity of the firebox (2), means (43*a*, 43*b*) connecting said at least one air outlet port (39*a*, 39*b*) of said distributor box (7) to said heat exchanger (45), wherein a portion of the amount of heat from the flue gases rising from the firebox (2) and/or of the radiant heat of the burning material in the firebox is transferred to the air supplied via the distributor box (7).

3. An air supply system according to claim 1, in which said plurality of pipes (5*a*, 5*b*, 5*c*, 5*d*) are flexible pipes.

4. An air supply system according to claim 1, in which said fresh air intake box (3) has mutually opposed side walls, and said at least one air inlet port (38) and said plurality of pipe connection members (29*a*, 29*b*, 29*d*) are in said mutually opposed side walls.

5. An air supply system according to claim 4, in which said fresh air intake box (3) includes a tube (25) forming said at least one air inlet port (38), said tube (25) telescopically connected in one of said mutually opposed side walls and in communication with air outside the building and telescopically movable out of said fresh air intake box (3) to adapt the depth of said fresh air intake box (3) to the thickness of an outside wall (19) of a building.

6. An air supply system according to claim 4, in which said at least one air inlet port (38) extends approximately the entire width of one of said mutually opposed side walls of said fresh air intake box (3), and said fresh air intake box (3) having two additional side walls (33*a*, 33*b*) connected between said mutually opposed side walls and at least partially slightly converging toward each other from said air inlet port (38) toward the other of said mutually opposed side walls having said plurality of pipe connection members (29*a*, 29*b*, 29*c*, 29*d*).

7. An air supply system according to claim 1, in which said distributor box (7) has a first side wall and a second side wall extending approximately perpendicularly to said first side wall, said at least one air outlet port (39*a*, 39*b*) connected in said first side wall, and said plurality of second pipe connection members (41*a*, 41*b*, 41*c*, 41*d*) connected in said second side wall.

8. An air supply system in the ceiling of a building for feeding air to a firebox within the building above the ceiling, comprising a fresh air intake box connected in the outside wall of the building, said fresh air intake box having a plurality of pipe connection members and at least one air inlet port in communication with air outside the building;

a distributor box, said distributor box having a plurality of second pipe connection members and at least one air outlet port, said distributor box being located in the proximity of the firebox, and a plurality of pipes installed in the ceiling of the building connecting said plurality of pipe connection members on said fresh air intake box with said plurality of second pipe connection members on said distributor box;

and said fresh air intake box in the outer wall of the building lying in approximately the same horizontal plane with said distributor box.

9. Method of providing an air supply system in a building during construction, for supplying air to a firebox within the building, comprising the steps of:

installing a distributor box having at least one air outlet port and a plurality of pipe connection members in the form of a building ceiling during construction of the ceiling, below the site of a firebox, to be constructed;

positioning the distributor box with the at least one air outlet port in an upwardly directed position;

connecting a plurality of pipes with the plurality of pipe connection members on the distributor box;

inserting a fresh air intake box having an air inlet port and a plurality of second pipe connection members in an outside wall of the building in such a way that the air inlet port is positioned toward the outside of and is in communication with the outside of the outside building wall to be constructed, and the plurality of second pipe connection members are positioned toward the inside of the building ceiling;

and connecting the plurality of pipes connected with the distributor box to the plurality of second pipe connection members of the fresh air intake box.

10. Method of providing an air supply system in a building as set forth in claim 9, including at least partially filling the inner spaces of the distributor box and/or fresh air intake box with foam material and blocking the respective at least one air outlet port and air inlet port; and pouring concrete into the form of the building ceiling and completing the erection of the outside wall of the building, whereby concrete and dirt are excluded from the interior of the distributor box and fresh air intake box, and the weight of material on the boxes does not deform the boxes, during construction.

11. Method of providing an air supply system in a building as set forth in claim 9, including pouring concrete into the form of the building ceiling and completing the erection of the outside wall of the building;

installing a firebox above the completed ceiling and above the distributor box;

installing a heat exchanger on the firebox so that it can be heated by the firebox, said heat exchanger being in communication with the space above the completed ceiling and around the firebox; and connecting the at least one air outlet port of the distributor box with the heat exchanger.

* * * * *